US005209572A

United States Patent [19]

Jordan

[11] Patent Number: 5,209,572

[45] Date of Patent: May 11, 1993

[54] THIN DRAWER SLIDE

[75] Inventor: Kent A. Jordan, Long Beach, Calif.

[73] Assignee: Accuride International, Inc., Santa Fe Springs, Calif.

[21] Appl. No.: 790,239

[22] Filed: Nov. 8, 1991

[51] Int. Cl.[5] ..... F16C 29/04

[52] U.S. Cl. ..... 384/18; 312/334.7

[58] Field of Search ..... 384/18-20, 384/23, 53; 312/330-347

[56] References Cited

U.S. PATENT DOCUMENTS

| | | | |
|---|---|---|---|
| 3,059,978 | 10/1962 | Fall . | |
| 3,205,025 | 2/1963 | Jordan . | |
| 3,452,977 | 7/1969 | Ryman . | |
| 3,650,578 | 3/1972 | Del Vecchio et al. | 384/18 |
| 3,679,275 | 7/1972 | Fall et al. . | |
| 3,687,505 | 8/1972 | Fall et al. . | |
| 3,712,690 | 1/1973 | Fall . | |
| 3,738,716 | 6/1973 | Lambert . | |
| 3,771,849 | 11/1973 | Barber . | |
| 3,776,608 | 12/1973 | Fall et al. . | |
| 3,857,618 | 12/1974 | Hagen et al. | 312/331 X |
| 3,901,564 | 8/1975 | Armstrong . | |
| 4,047,767 | 9/1977 | Foust | 384/23 |
| 4,194,793 | 3/1980 | Offermans . | |
| 4,272,139 | 6/1981 | Fler | 312/334 |
| 4,537,450 | 8/1985 | Baxter . | |
| 4,653,821 | 3/1987 | Faust | 384/18 X |
| 4,752,142 | 6/1988 | Jackson et al. | 384/18 |
| 4,872,734 | 10/1989 | Rechberg | 312/333 |
| 4,932,792 | 6/1990 | Baxter | 384/18 |
| 4,952,074 | 8/1990 | Röck | 384/53 X |
| 4,991,981 | 2/1991 | Baxter | 384/18 |
| 5,020,869 | 6/1991 | Faust | 384/18 X |
| 5,022,768 | 6/1991 | Baxter | 384/19 |

FOREIGN PATENT DOCUMENTS

| | | | |
|---|---|---|---|
| 219364 | 6/1958 | Australia | 384/18 |
| 0291811 | 11/1988 | European Pat. Off. . | |
| 0406647 | 1/1991 | European Pat. Off. . | |
| 3324379 | 1/1985 | Fed. Rep. of Germany . | |
| 20914 | 3/1946 | Finland | 384/18 |
| 1034068 | 7/1953 | France | 312/340 |
| 659534 | 10/1951 | United Kingdom | 384/18 |
| 783826 | 10/1957 | United Kingdom | 312/340 |
| 2028109 | 3/1980 | United Kingdom . | |
| 2061705 | 5/1981 | United Kingdom . | |

*Primary Examiner*—Thomas R. Hannon
*Attorney, Agent, or Firm*—Christie, Parker & Hale

[57] ABSTRACT

A thin profile drawer slide apparatus for slidably supporting a heavy drawer in an article of furniture, comprising outside channels for slidably attaching the apparatus to a drawer and an article of furniture, a plurality of bearings slidably retained in the channels by parallel, opposed bearing retainers, and by a one-piece, generally "I"-shaped intermediate slide member or retaining member unitarily formed with top and bottom parallel raceway means for guiding the bearing retainers. Use of a single intermediate slide member with raceways for four separate sets of bearings enables construction of a thin, strong drawer slide for carrying heavy loads.

6 Claims, 8 Drawing Sheets

Fig. 1
PRIOR ART
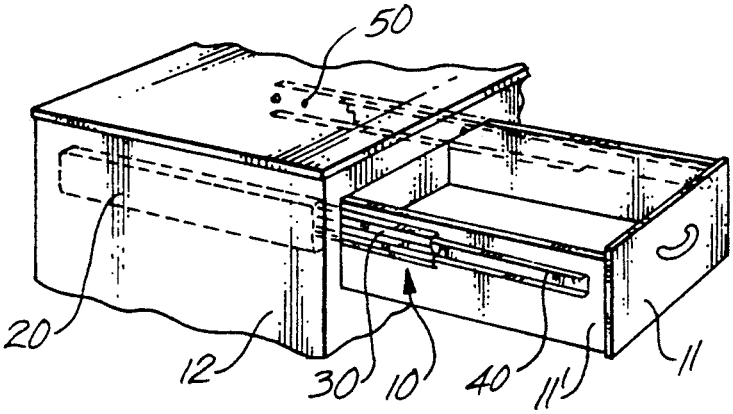
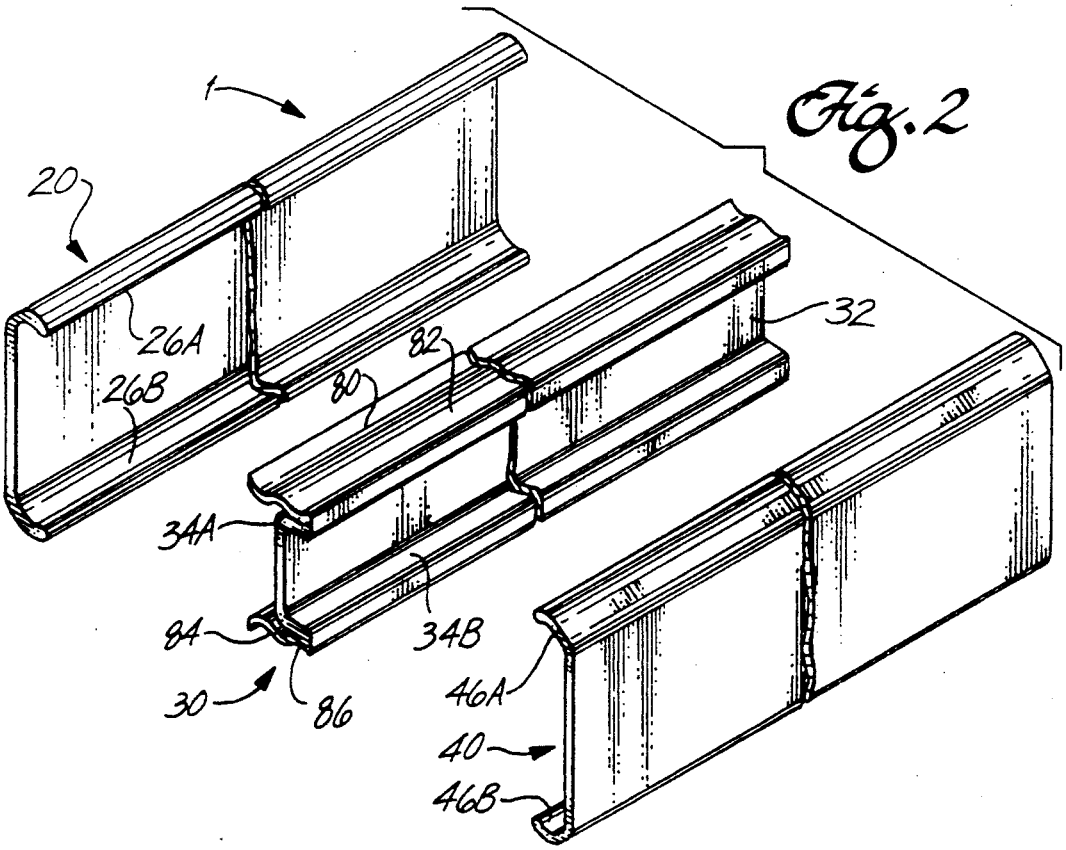
Fig. 2

THIN DRAWER SLIDE

FIELD OF THE INVENTION

The present invention generally relates to slide mechanisms for drawers slidable in enclosures such as articles of furniture. The invention specifically relates to a thin-profile, three-part heavy-duty ball bearing drawer slide mechanism.

BACKGROUND OF THE INVENTION

To reduce friction and enable a drawer or sliding device to withstand a heavy load, slides for enclosures such as file cabinets and other furniture employ bearings to reduce wear. Specialized enclosures and furniture for medical, industrial, and engineering applications often requires thin drawers and thin drawer slides. Such applications also require a heavy-duty slide.

In a full-extension slide, two pairs of bearing raceways (bearing travel surfaces) for four sets of ball bearings are usually required to bear a typical load. The use of four separate sets of ball bearings poses obstacles to miniaturization of the slide. Furniture designers desire the slide to be thin in the horizontal or lateral direction, thereby enabling a drawer to be as wide as possible compared to the opening in which it slides. Moreover, designers want slides which are short in the vertical direction to keep the slide unobtrusive and cosmetically attractive, and to enable use with thin drawers.

In most drawer slides of the prior art, the four separate ball bearing assemblies are aligned in pairs on two vertical axes. To make a drawer slide thin in the horizontal direction, designers have focused on making the relative vertical separation of one pair of bearings narrower than the other. This enables the axes of the bearing pairs to become nearly collinear, resulting in a thin slide.

For example, U.S. Pat. No. 5,022,768 (Baxter) discloses, in FIG. 1, a prior art slide mechanism in which the ball bearing pairs are on nearly collinear vertical axes. This results in a vertically tall slide which is expensive to manufacture and very obtrusive when seen on an open drawer. Also, two different sized ball retainers are needed, further increasing cost.

FIGS. 3, 4, and 7 of U.S. Pat. No. 4,469,384 (Fler et al.) discloses a similar collinear axis slide. However, the resulting slide is not symmetrical, requiring separate fabrication of the outer and inner channel members. This increases manufacturing costs. Also, the inner channel member is very narrow, providing little space to mount the large fasteners, bolts or tabs required in a heavy-duty application. Designers desire to provide a slide which reduces manufacturing costs by incorporating symmetrical parts, and which provides a large mounting surface area.

Another approach of the prior art is to use noncollinear bearing pairs in which separate central retainer members serve as raceways for the bearings. For example, FIG. 1 of U.S. Pat. No. 3,712,690 (Fall) discloses a drawer slide comprising inner and outer rails and an intermediate element operatively associated with both rails to permit longitudinal sliding movement along the three major elements. The intermediate element indicated generally by numeral 24 comprises a bar 25 formed to define longitudinal trackways 26 and 27 receiving bearings 15 and 16. An identical, oppositely arranged bar 28 is secured to the bar 25 and provides outwardly opening trackways 29 and 30.

Use of separate bars 25 and 28 make the device of Fall susceptible to bending and twisting stresses. Also, a separate manufacturing operation is needed to fasten the bars 25, 28. Thus, designers of drawer slides desire to provide a slide in which the central slide member is structurally stable, and in which few manufacturing operations are needed.

SUMMARY OF INVENTION

Accordingly, the present invention provides a vertically and laterally thin slide apparatus for slidably supporting a heavy article or drawer in an enclosure, comprising elongated outside channel means for slidably attaching the apparatus to a drawer and an enclosure, a plurality of bearings slidably retained in the channel means by parallel, opposed bearing retainers, and by an inner retaining means comprising a central member unitarily formed with top and bottom parallel pairs of raceways for guiding the bearings. Use of a single central member with raceways for four separate sets of bearings enables construction of a thin, strong drawer slide for carrying heavy loads. In the presently preferred embodiment, the central member is formed to resemble an "I" beam with the raceways formed in doublethickness arms of the "I" using short lateral walls secured using a hairpin bend to raceway members.

BRIEF DESCRIPTION OF DRAWINGS

FIG. 1 is a perspective view of a prior art drawer and slide arrangement;

FIG. 2 is an exploded, isometric view of the slide elements of the invention;

DETAILED DESCRIPTION

Figure 3A:
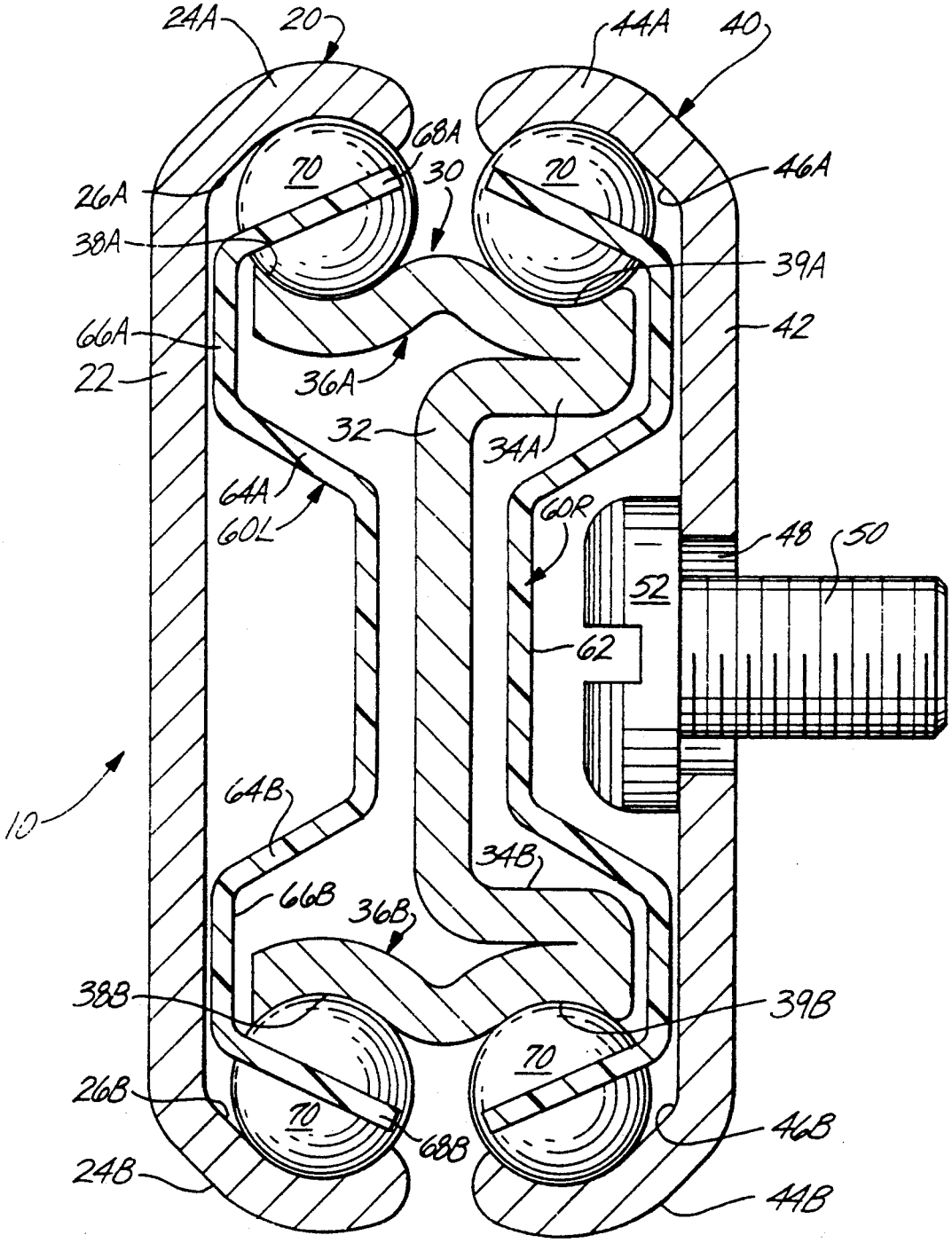
FIG. 3*a* is a cross-section of a first embodiment of a slide taken along line 3—3 of FIG. 4.

In the following detailed description of the preferred embodiments, specific terminology is used for the sake of clarity However, the invention is not limited to the specific terms selected, but rather includes all technical equivalents functioning in a substantially similar manner to achieve a substantially similar result.

General construction details of so-called three part drawer slides are well known in the art. Three part drawer slides are used in full extension applications whereas a two-part slide can only achieve three-quarters extension. Typical prior art three part drawer slides, ball bearing retainers, channel members and stop mechanisms are shown in U.S. Pat. Nos. 4,537,450 (Baxter); 4,991,981 (Baxter); and the patent references discussed above in the section entitled "Background of the Invention." The reader is directed to these references for general construction details and configurations of three part drawer slides.

FIG. 1 shows a typical three-part slide installation for an enclosure and drawer. A drawer slide 10 provides means for sliding a drawer 11 in enclosures such as an article of furniture 12. The drawer slide comprises an outer slide member 20 which is affixed to an interior wall of the article of furniture; an intermediate slide member 30 which is slidable in the outer member 20; and an inner slide member 40 affixed to a side wall 11' of the drawer. Ball bearings enable slide member 40 to smoothly telescope in and out of the intermediate member 30. Likewise, ball bearings mounted between intermediate member 30 and outer member 20 enable the intermediate member to slide through the outer member. The bearings are mounted in bearing retainers which are omitted from FIG. 1 for clarity. A stop (not shown) is usually provided to prevent the drawer from being pulled entirely out of the article of furniture.

Figure 4:
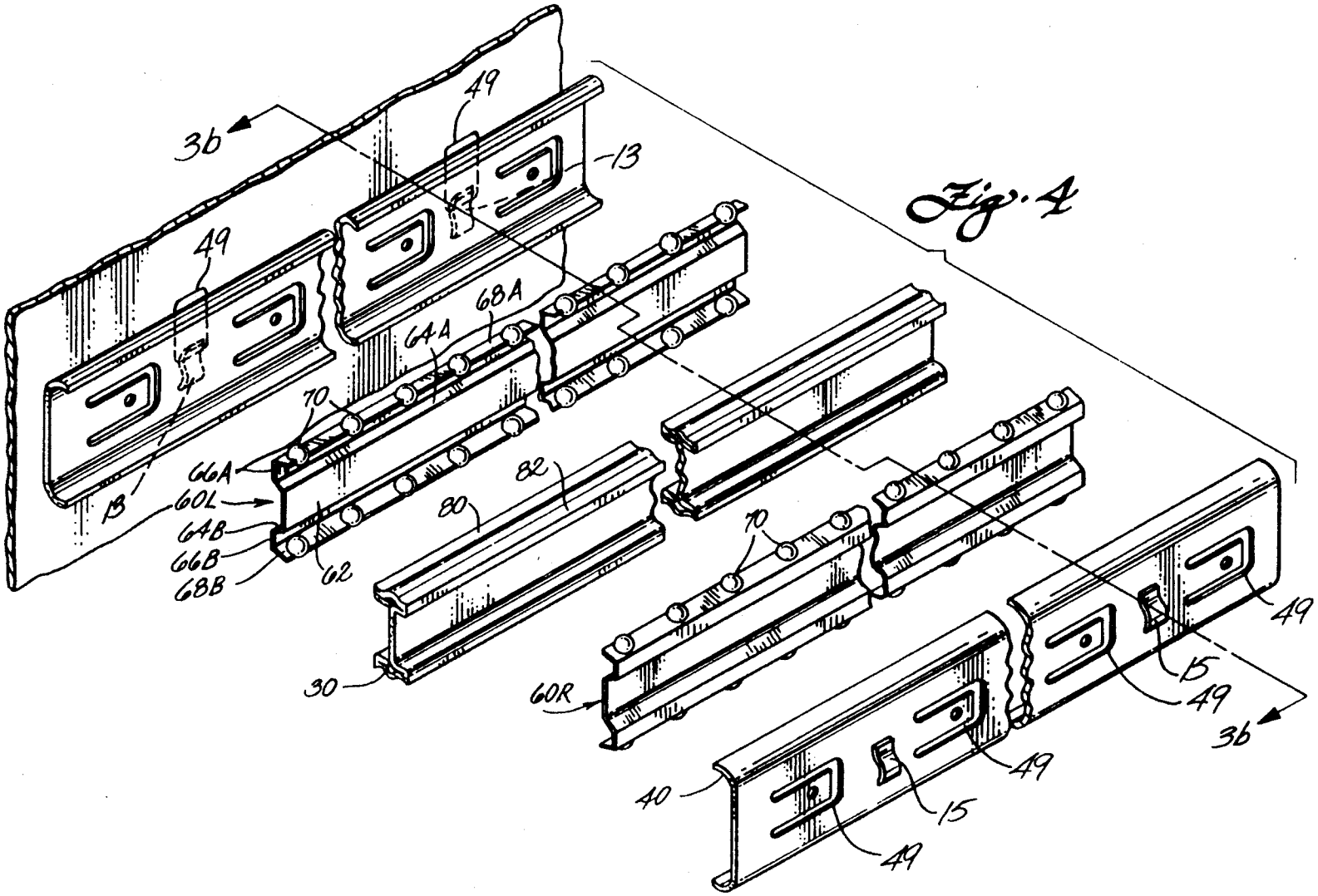
FIG. 4 is an exploded isometric view of the preferred embodiment of FIG. 3*b.

The present invention provides a device for use in three-part drawer slides of the general type disclosed in the references cited above. Referring to FIG. 2, a first embodiment of a slide 1 of the invention comprises symmetrically identical left and right outer outside channel members or channel means 20, 40 for slidably attaching the slide to a drawer and an enclosure or article of furniture. An inner retaining member or retaining means 30 is provided for slidably retaining ball bearings or bearing retainers between the outside channel members. The bearing retainers are not shown in FIG. 2 for clarity but are shown in FIG. 4. The outside channel members can be made in any desired length to fit drawers of different sizes.

Since the outside channel members are symmetrical, either the left channel member 20 or the right channel member 40 can be affixed to the interior of the enclosure. Likewise, either of the outside channel members can be secured to the drawer. Moreover, both channel members provide a large surface area to receive a fastener.

A detailed cross-section view of one embodiment is provided in FIG. *3a*. In FIGS. *3a* and *3b*, like parts of channel members 20, 40 are designated with corresponding reference numerals. The discussion below relates to the right outside channel member 40 in FIG. *3a*, but the same parts are provided in symmetrically opposite locations on the left outside channel member. Indeed, the left and right channel members can be manufactured in identical form and assembled in opposite orientation, thereby reducing manufacturing costs and time.

The outside channel members can be made of roll-formed metal such as cold-rolled steel or stainless steel or any other rigid material. Alternatively, the channel members and inner or intermediate slide members can each be made of extruded or broached metal or any other rigid material. As indicated, the left and right outside channel members 20, 40 each include a generally vertical wall 22, 42. Preferably, the vertical wall 42 is unitarily formed with upper and lower inwardly curved retaining walls 44A, 44B. In this description, "inwardly" means toward a vertical center axis of an inner slide member 32. Each curved retaining wall includes an interior raceway or bearing surface 46A, 46B. The bearing surface provides a first sliding surface or raceway for a plurality of ball bearings 70.

A hole 48 can be provided in the vertical wall to enable securement of the slide apparatus to a drawer or enclosure using a threaded fastener 50. A #6 pan head screw can be used for fastening the slide to furniture. Of course, any suitable type of fastener can be used. In metal furniture or enclosures, bayonet tabs are preferred in the trade rather than screws. Accordingly, the hole 48 can be omitted or replaced with the bayonet tabs or other suitable fastening means.

The ball bearings 70 are retained in left and right ball bearing retainers 60L, 60R. The ball bearing retainers are symmetrically identical, thereby reducing manufacturing costs by enabling a single type of retainer to be used on both sides of the apparatus. As is indicated in the drawing, both left and right retainers 60L, 60R include corresponding parts in a like arrangement.

The right ball bearing retainer 60L includes a centrally indented or inwardly formed vertical wall 62. The deformation of the wall provides clearance space for a fastener such as the head 52 of the threaded fastener 50. The vertical wall 62 is joined using upper and lower angled walls 64A, 64B to upper and lower vertical walls 66A, 66B. The upper and lower walls are, in turn, connected to retaining arms 68A, 68B.

The general construction of ball bearing retainers is well-known in the art. The retainers ensure that each ball remains spaced apart from its neighbor. For example, the ball bearing retainer disclosed in U.S. Pat. No. 4,991,981 (Baxter) or 3,712,690 (Fall) is suitable for incorporation in the mechanism disclosed herein.

A central, intermediate or inner slide member 32 is provided and preferably is formed in a generally "I"-shaped single piece of roll-formed steel. Extrusion or broaching of the inner slide member are also specifically contemplated, and plastic polymers such as Delrin, or any other rigid material can be used. The unitary construction adds structural stability and reduces manufacturing costs of the entire apparatus. Moreover, the central member may be inverted or reversed without affecting the operation of the mechanism.

As indicated in FIG. *3a*, the inner slide member 30 comprises a central vertical wall 32 unitarily formed with upper and lower short horizontal walls 34A, 34B. Preferably, the horizontal walls are joined at an approximately right angle to the central wall. Using a sharp or hair pin bend, the walls 34A, 34B are bent back upon themselves to form upper and lower parallel raceway members 36A, 36B. Preferably, each of the raceway members includes two abutting arcuate raceways 38A, 39A and 38B, 39B. The raceways provide a second sliding surface or raceway for each of the ball bearings 70.

Thus, in operation, when the outside channel members are moved in or out, a ball bearing will simultaneously rotate on the raceway formed by the inside of the outside channel members and the outward-facing surfaces of the raceways on the inner slide member.

Preferably, a central vertical axis of the central wall of the inner slide member is located directly between parallel vertical axes of the ball bearings. Thus, the central wall 32 forms a center line or center point of the mechanism.

A presently preferred embodiment of the central member is shown in FIG. *3b*. This preferred embodiment includes additional short horizontal or lateral walls 34C, 34D integrally joined to the adjacent arcuate parallel raceways 39A, 39B. The lateral walls can be formed by an additional sharp or hairpin bend 94 in the metal used to form the raceways 39A, 39B. The walls 34C, 34D are folded over and abut the upper and lower shoulders 92A, 92B of the central wall 32. This arrangement results in a narrow airspace 90 running longitudinally through the central member 32. In a third alternate embodiment, shown in FIG. *3c*, this air space can be eliminated by forming the central member as a solid cold-rolled section of metal. Such a third embodiment would have the perimeter profile shown in FIG. 3*b*, but air space 90 would be filled with solid metal.

Figure 3B:
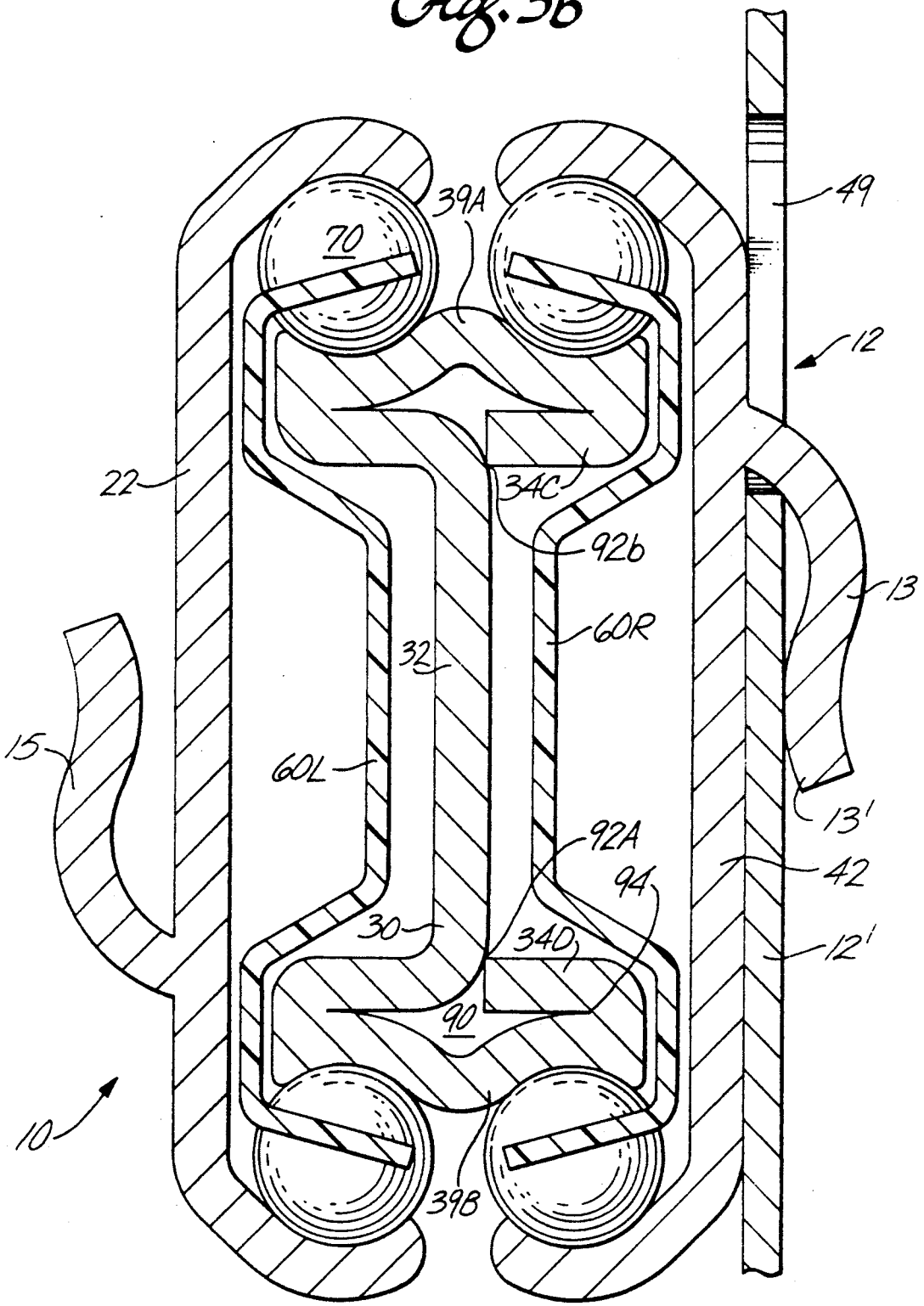
FIG. 3*b* is a section view of a second, preferred embodiment of the slide of FIG. 2.

The preferred embodiment of FIG. 3*b* adds further structural strength to the central member by providing a double-thickness raceway structure since a lateral wall is disposed under each raceway. This enables the central member to carry weight, in the range of about seventy-five to one hundred pounds. The embodiment of FIG. 3B can be incorporated in a slide with the structure of FIG. 4.

Figure 3C:
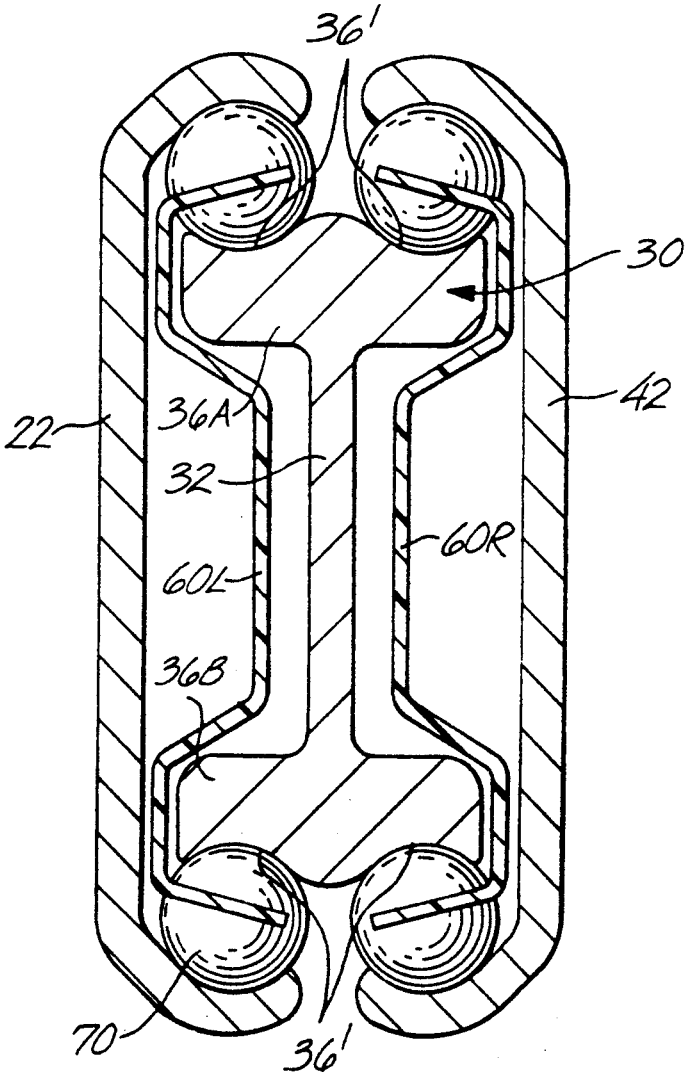
FIGS. 3*c* to 3*e* are section views of third, fourth, and fifth embodiments.
Figure 3D:
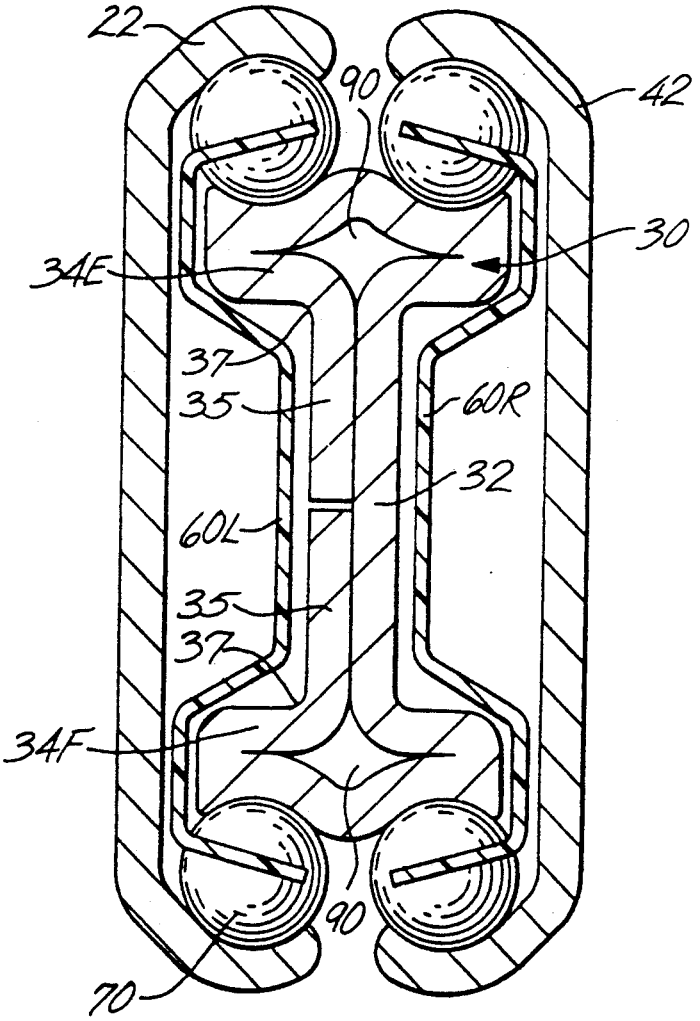
Figure 3E:
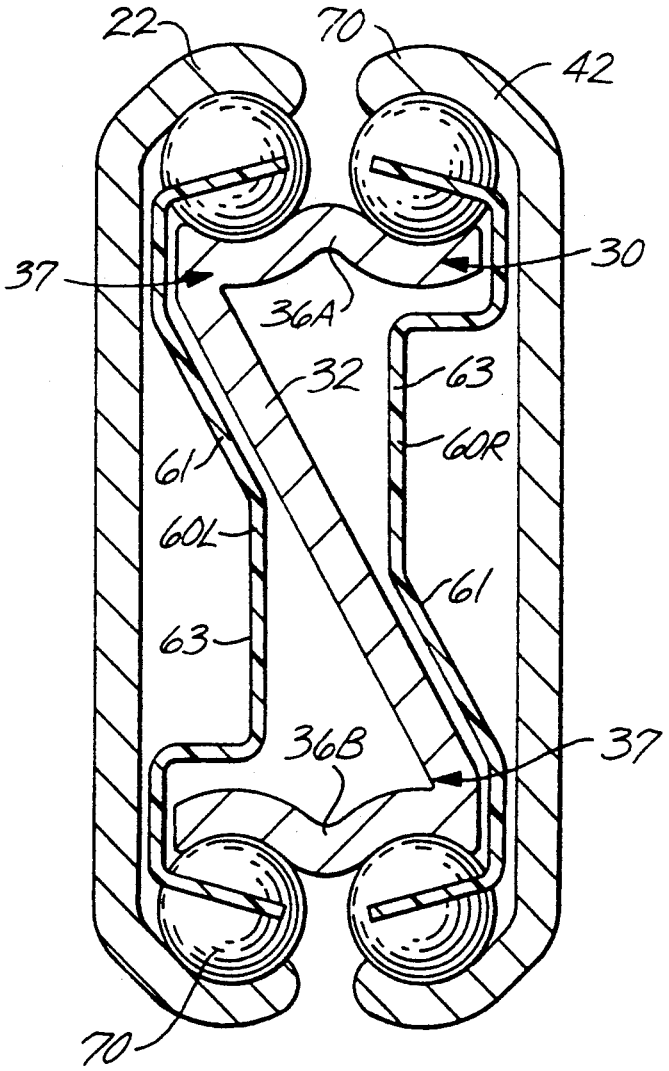

FIGS. 3*c*, 3*d*, and 3*e* show alternate embodiments of the central or inner member 30. In FIG. 3*c*, the inner member is formed as a solid bar of rolled material in a generally "I"-shaped form. The bar comprises a vertical central wall 32 and upper and lower plates 36A, 36B. The plates each have plural, parallel arcuate raceways 36' formed therein. Preferably, the solid center member comprises a single roll-formed metal bar, such as a cold-rolled steel bar.

FIG. 3*d* illustrates an arrangement with double-thickness raceway members and a double-thickness central vertical wall. The embodiment of FIG. 3*d* is similar to FIG. 3*b*. However, in FIG. 3*d* the short lateral walls 34C, 34D of FIG. 3*b* are replaced with walls 34E, 34F. Each of the walls comprises a short lateral wall joined to a vertical wall 35. The lateral wall and the vertical wall are preferably integrally joined at approximately a 90° angle indicated by reference numeral 37. The central member can be formed from a single, roll-formed strip or sheet of metal or other rigid material The walls 34E, 34F can be formed by roll-forming extensions of the raceway members, 36A, 36B so that the raceway members wrap around with an additional hairpin bend and an angular bend at point 37. Thus, the entire central member can be formed from a single flat strip of metal using an appropriate number of roll-forming operations. This arrangement results in a generally "I"-shaped member with double-thickness raceways and a double-thickness central member which is extremely strong. The member has the structural characteristics and strength of an "I"-beam but omits material in the air spaces 90, thereby reducing material costs.

In FIG. 3*e*, the intermediate member is formed as a generally "Z"-shaped member having a central wall 32 diagonally disposed with respect to the outer members 22, 42. Top and bottom raceway members 36A, 36B are joined to the top and bottom ends of the central wall 32 at an acute angle indicated by reference numeral 37. In this arrangement, the cross-section profile of the bearing retainers 60L, 60R is modified to accommodate the angled profile of the intermediate member. In particular, each bearing retainer comprises a generally vertical, centrally-deformed portion 63 and an angled portion 61. The angled portion of the bearing retainer is formed parallel to the angled central wall. Thus, the modified bearing retainer provides clearance for a fastener to protrude adjacent to the central member, and accommodates the angled shape of the central member.

Several mounting arrangements are possible. As shown in FIGS. 4 and 3*b*, the outer slide members 20, 40 can be provided with a plurality of outwardly extending bayonet tabs 13, 15. FIG. 3*b* shows a side wall 12' of an enclosure 12. A bayonet tab 13 formed integrally with the outer slide member protrudes outwardly into the enclosure and engages a slot or hole 49 in the enclosure. The tabs can be integrally formed with the outer slide members or can be welded thereto. The tabs are formed with an "S"-curved section 13' which enables the tabs to securely grip the side wall via spring tension, as is known in the art. When a plurality of tabs are used, the slide can be held rigidly against the wall 12'. Upwardly facing tabs 15 can be provided on the opposite outer slide member for engaging matching slots in a drawer (not shown) of the enclosure.

This mounting arrangement is preferred in metal furniture such as file cabinets, in which screws do not provide enough shear strength or would protrude from the cabinet and be aesthetically unappealing. As one skilled in the art will recognize, the exact arrangement and number of tabs and slots is not critical, and can vary depending on the load-carrying capacity desired for the slide. Also, the side wall 12 can be spaced apart from an interior wall of the enclosure (not shown) and welded thereto. In use, a furniture manufacturer places the corresponding slots of the slide over the tabs prefabricated in the furniture, and pushes the slide firmly down onto the tabs, resulting in a tight, permanent securement.

Figure 5A:
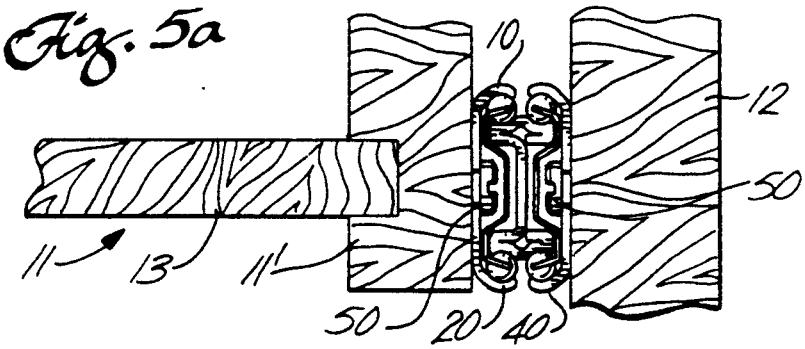
* and FIG. 5*a* to 5*c* are section views of alternate embodiments of the invention.

FIG. 5*a* shows a typical mounting arrangement for a drawer slide 10 secured between a wall of an enclosure 12 and a side wall 11' of a drawer 11. Mounting screws 50 are used to secure the outer members of the slide to the drawer and enclosure.

Figure 5B:
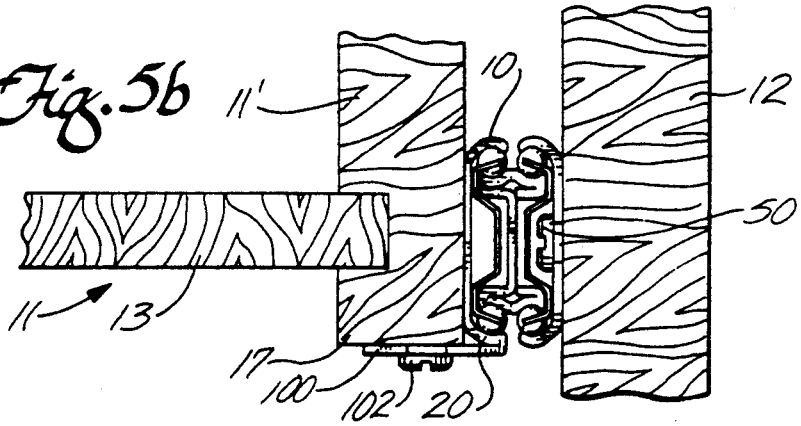
Figure 5C:
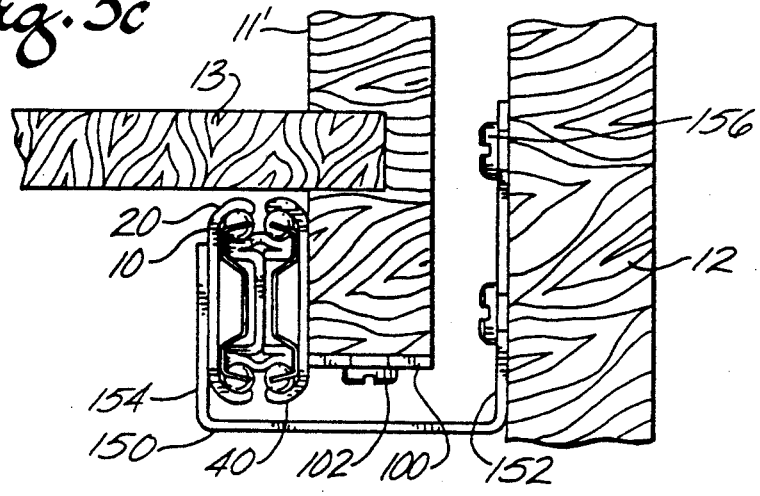

Alternate mounting arrangements are shown in FIGS. 5*b* and 5*c*. A lip mounting arrangement is shown in FIG. 5*b*, in which a flat mounting plate 100 is spot-welded or formed integrally with one outside member 20. The plate can be secured to the bottom lip 17 of the drawer wall 11' using a suitable screw or fastener 102.

FIG. 5*c* shows a shrouded or undermount arrangement. The plate 100 is secured to an outer member 40 of the slide by welding or other rigid securement. A vertical fastener 102 secures the plate 100 to the side wall 11' of the drawer. Additionally, a "U"-shaped bracket 150 is used to secure the slide in a spaced apart relationship with enclosure 12. The bracket includes spaced-apart vertical walls 152, 154 which are respectively secured to the enclosure and to an outside member of the slide. The first vertical wall 152 can be secured to the enclosure using any suitable fastener 156, such as a screw. The second vertical wall 154 is a preferably spot-welded to the outer slide member 20, i.e., the outer member opposite the plate 100.

As indicated above, the present invention provides a novel and unique apparatus for facilitating support and smooth sliding of drawers in articles of furniture. A unitarily-formed central or inner slide member provides a plurality of raceways for four separate sets of ball bearings, with reduced manufacturing costs and simpler construction than shown in the prior art.

The invention may be practiced in many ways other than as specifically disclosed herein. For example, the drawings are not rendered to scale and the size of vertical walls 22, 42, 32, 62 can be modified. Thus, the scope of the invention should be determined from the appended claims, in which

What is claimed is:

1. A full-extension slide apparatus for slidably supporting a drawer, comprising:

left and right channels for mounting the apparatus to a drawer and an article of furniture; and a plurality of bearings slidably retained in the channels by an "I"-shaped central member having a single vertical wall of a single thickness unitarily formed with top and bottom pairs of raceways for guiding the bearings, the central member having a homogenous cross section, whereby the thickness of the slide apparatus is minimized.

2. The apparatus of claim 1, each of the pairs of raceways comprising a plurality of abutted arcuate bearing raceways formed as a continuous piece with the central wall.

3. The apparatus of claim 1, wherein the pairs of raceways are double the thickness of the central member and unitarily roller formed therewith.

4. The apparatus of claim 1, wherein the central member is a single solid "I"-shaped bar having top and bottom plates extending laterally on each side therefrom forming adjacent pairs of arcuate raceways in each of the plates.

5. A generally "Z"-shaped intermediate slide member comprising top and bottom generally horizontal walls, each of the horizontal walls having a pair of raceways formed therein and having opposite lateral ends respectively affixed at a first acute angle to top and bottom ends of a single angularly disposed central wall , the first acuate angle having an angular measurement greater than a second angle defined by the central wall and a vertical axis perpendicular to the horizontal walls.

6. A slide apparatus comprising:

left and right vertical channel members;

a plurality of bearings retained in bearing retainer means and slidable in the channel members; and a generally "Z"-shaped intermediate member for slidably guiding the bearings, the intermediate member comprising top and bottom generally horizontal walls, each of the horizontal walls having a pair of raceways formed therein and having opposite lateral ends respectively affixed at a first acute angle to top and bottom ends of a single angularly disposed central wall, the first acute angle having an angular measurement greater than a second angle defined by the central wall and a vertical axis perpendicular to the horizontal walls.

* * * * *

UNITED STATES PATENT AND TRADEMARK OFFICE

CERTIFICATE OF CORRECTION

PATENT NO. : 5,209,572

DATED : May 11, 1993

INVENTOR(S) : Kent A. Jordan

It is certified that error appears in the above-indentified patent and that said Letters Patent is hereby corrected as shown below:

Column 2, line 49, after "clarity" insert a period.

Column 5, lines 19,20, change "col-drolled" to -- cold-rolled --.

Column 5, line 31, after "material" insert a period.

Column 6, line 44, after "154 is" delete "a".

In the Claims

Column 8, line 2, change "acuate" to -- acute --.

Signed and Sealed this

Fourteenth Day of June, 1994

Bruce Lehman

*Attest:*

BRUCE LEHMAN

*Attesting Officer*

*Commissioner of Patents and Trademarks*